US008122632B2

(12) United States Patent
Bentley

(10) Patent No.: US 8,122,632 B2
(45) Date of Patent: Feb. 28, 2012

(54) DYNAMIC MAGAZINE LATCH

(75) Inventor: James K. Bentley, Meridian, ID (US)

(73) Assignee: Krow Innovation, LLC, Paso Robles, CA (US)

( * ) Notice: Subject to any disclaimer, the term of this patent is extended or adjusted under 35 U.S.C. 154(b) by 0 days.

(21) Appl. No.: 12/612,910

(22) Filed: Nov. 5, 2009

(65) Prior Publication Data

US 2011/0099869 A1 May 5, 2011

(51) Int. Cl.
*F41A 9/01* (2006.01)

(52) U.S. Cl. ..... 42/6

(58) Field of Classification Search ..... 42/6, 7, 42/49.01, 49.02, 50, 49.1, 18, 22, 17, 19, 42/75.01–75.03; 403/109.3, 166, 304, 359.4, 403/325, 326; 89/33.1
See application file for complete search history.

(56) References Cited

U.S. PATENT DOCUMENTS 465,339 A * 12/1891 Browning ..... 42/18
617,500 A * 1/1899 Ehling ..... 403/106
666,084 A * 1/1901 Burgess ..... 89/149
1,433,945 A * 10/1922 Eickhoff ..... 89/154
2,305,033 A * 12/1942 Roemer ..... 42/18
2,454,613 A * 11/1948 Peltier et al. ..... 296/97.13
2,494,159 A * 1/1950 Bernstein ..... 220/759
2,797,515 A * 7/1957 Pagett ..... 42/75.02
2,980,456 A * 4/1961 McMullin ..... 403/328
3,715,826 A * 2/1973 Seifried ..... 42/70.06
4,047,821 A * 9/1977 Hoke et al. ..... 403/109.3
4,580,363 A * 4/1986 Rowe, Jr. ..... 42/18
4,867,039 A * 9/1989 Dobbins ..... 89/127
5,027,541 A * 7/1991 Velezis ..... 42/18
5,253,442 A * 10/1993 Kim ..... 42/50
5,473,834 A 12/1995 Bammate
5,588,338 A * 12/1996 Carr et al. ..... 74/560
5,685,101 A 11/1997 Ferretti
5,771,620 A * 6/1998 Crawford et al. ..... 42/19
6,131,928 A * 10/2000 Tung ..... 280/47.315
6,854,916 B2 * 2/2005 Hsieh ..... 403/109.3
6,912,806 B2 * 7/2005 Malindretos ..... 42/17
7,762,739 B2 * 7/2010 Blanchard ..... 403/322.2
2007/0003361 A1 * 1/2007 Wang ..... 403/109.3
2009/0107023 A1 4/2009 Murphy

OTHER PUBLICATIONS

US Patent and Trademark Office, Office Action for U.S. Appl. No. 13/020,733, filed Feb. 3, 2011, mailed Jun. 27, 2011, USA.

* cited by examiner

*Primary Examiner* — Bret Hayes
*Assistant Examiner* — Reginald Tillman, Jr.
(74) *Attorney, Agent, or Firm* — Parsons Behle & Latimer

(57) ABSTRACT

A dynamic latch to selectively retain a magazine within the magazine port of a long gun. The dynamic latch permits the magazine to be inserted into the magazine port by movement in a single direction eliminating the need to rotate the magazine in order to secure it within the magazine port. The dynamic latch may also eliminate the need to add a magazine well to the receiver of a shotgun or long gun. The dynamic latch may include an outer housing, a piston positioned within the housing, and a spring positioned within the piston. A latch profile on the end of the piston may extend out of an opening in the end of the housing when the spring is in an uncompressed state. The dynamic latch may also be used to connect a tube, such as a magazine tube, to the receiver.

13 Claims, 6 Drawing Sheets

DYNAMIC MAGAZINE LATCH

BACKGROUND OF THE INVENTION

1. Field of the Invention

The present disclosure generally relates to a front dynamic magazine latch for selectively retaining an ammunition magazine in the magazine port of a long gun. Specifically, the dynamic latch selectively retains a magazine within the magazine port of a shotgun and permits the magazine to be inserted into the magazine port by movement in a single direction. The dynamic latch eliminates the need to rotate the magazine to secure the magazine within the magazine port. The dynamic latch may also eliminate the need to add a magazine well to the shotgun receiver or long gun receiver. The dynamic latch may be used in a standard shotgun receiver and may also permit that attachment of a tube, such as a magazine tube, to the receiver.

2. Description of the Related Art

In the field of firearms, there is a need to improve the shell carrying capacity for long guns, including shotguns. One type of repeating shotgun is a pump-action shotgun. An example of a prior art pump-action shotgun 300 is shown in FIG. 5. The pump-action shotgun includes a receiver 310 into which a magazine tube 390 and a barrel 395 may be inserted. The receiver 310 of the shotgun 300 is the main component that houses the chamber and firing mechanism. The magazine tube 390 is a tube that generally runs parallel underneath the barrel 395 of the shotgun and that can hold shotgun shells. The number of shells that the magazine tube 390 is constrained to its length. Five shells is often the maximum number of shells that a magazine tube 390 can hold. The end of the magazine tube 390 that is inserted into the receiver 310 usually includes exterior threads 391 (shown in FIG. 6) so that the magazine tube 390 can be secured to a threaded opening 311 of the receiver 310.

The barrel 395 of the pump-action shotgun 300 is inserted into an upper opening 312 in the receiver 310 and includes a lug 396 that slides onto the front end (the far end from the receiver 310) of the magazine tube 390. The front end of the magazine tube 390 includes threads 392 as shown in FIG. 5 so that a nut (not shown) may be threaded onto the magazine tube 390 securely against the lug 396. The nut threaded against the lug 396 retains the end of the barrel 395 within the receiver 310. The pump-action shotgun 300 includes a pump grip 393 that is adapted to travel along the magazine tube 390. As is known to one of ordinary skill in the art, as the pump grip 393 is cycled a carriage (not shown) connected to the pump grip 393 is adapted to load a shell from the magazine tube 390 into the chamber and property position the bolt.

The introduction of a detachable shotgun magazine may increase the carrying capacity of the shotgun. FIG. 1 shows the side view of a typical configuration of a shotgun magazine 280. The shotgun magazine 280 includes a tab or locking profile 281 that engages a corresponding profile within the magazine port 213 of a shotgun receiver 210 (shown in FIG. 2). The corresponding profile is typically a static latching structure 282, such as another tab or recess, as shown in FIG. 4. In order to lock the magazine 280 into the magazine port 213, the operator first must align the locking tab 281 with the static latching structure 282. Once aligned, the magazine 280 then is rotated about the locking tab 281 to engage a second locking feature that corresponds to a release lever 285 (shown in FIG. 2). Once the magazine is locked into the magazine port 213, the release lever may be actuated to release the magazine 280 from the receiver 210. The requirement to first align to static structures and then rotate the magazine 280 to engage a second locking feature may potentially cause a user to improperly insert the magazine 280 into the magazine port 213. For example, if the locking profile 281 is not properly aligned with the static latching structure 282 the second locking feature may fail to properly lock the magazine 280 into the magazine port 213 instead causing the magazine 280 to fall out of the magazine port 213 when it is rotated to engage the second locking feature within the magazine port 213. The failure to properly insert and load the magazine may be especially problematic in high pressure situations, such as in combat.

Another type of shotgun is a gas powered semiautomatic shotgun. FIG. 2 shows a portion of a SAIGA® gas powered shotgun 200 with a magazine 280 being rotated to be inserted and locked into the magazine port 213 of the receiver 210. As shown in FIG. 2, the user of the gun is unable to view the mating of the static latching structures 281, 282 (shown in FIG. 4) while inserting the magazine 280, which may lead to misalignment prior to rotating the magazine 280 to engage the second locking profile on the release lever 285. The magazine 280 will not properly lock within the magazine port 213 if it is misaligned potentially allowing the magazine 280 to fall out of the magazine port 213.

FIG. 3 is a cross-section side view of a shotgun 200*a* having static latching structures 281, 282. FIG. 3 shows the magazine 280 partially inserted into the magazine port. A second static locking structure 286 has contacted the release latch 285*a*, but the magazine 280 is not fully rotated and thus, locked into the magazine port 213*a*. FIG. 4 is a close up cross-section view showing the static locking structure 281 of the magazine 280 properly aligned and engaged by the static latching structure 282 of the receiver 210*a*. In order to properly lock the magazine 280 into the magazine port 213*a*, the static locking structure 282 must be properly positioned and aligned above the static latching structure 281 of the receiver 210*a*. The engagement of latching structure 282 with locking structure 281 retains the magazine in the proper location within the magazine port 213*a*. Otherwise, the magazine 280 may simply come out of the magazine port 213*a* when the magazine 280 is rotated to engage the locking feature of the release lever 285*a*.

The addition of a magazine well (not shown) may help to prevent misalignment when a magazine 280 is inserted into the magazine port 213*a* of a shotgun 200*a*. However, the addition of a magazine well increases the complexity of the shotgun 200*a* as well as weight and cost. Additionally, the inclusion of a magazine well prevents the use of a standard shotgun receiver 210*a* requiring additional manufacturing costs. A magazine well typically provides a channel for the alignment of the magazine 280 as it is inserted into the magazine port with the locking profile of the release lever 285*a* securing the magazine 280 within the magazine port 213*a* and magazine well.

The present disclosure is directed to overcoming, or at least reducing the effects, of one or more of the issues set forth above.

SUMMARY OF THE INVENTION

An embodiment of a latch to selectively secure a magazine to a magazine port of a shotgun receiver is disclosed. The latch may comprise a body having a first end, a second end, an inner cavity, an exterior shoulder at the first end, a first interior shoulder at the first end, and a second interior shoulder at the second end, and a piston having a first end and a second end. The piston may be positioned within the cavity. The first end may include a latch profile adapted to selectively retain a locking profile on the magazine. The latch may also comprise a spring which may be positioned in the cavity between the piston and the second interior shoulder. A portion of the latch profile may protrude out of an opening in the first end of the body when the spring is in an uncompressed state. The locking profile may engage the latch profile to compress the spring and move the piston towards the second end of the body as the magazine is inserted into the magazine port. After the locking profile has passed the latch profile, the spring may move the piston toward the first end of the body so that the latch profile selectively retains the locking profile. The first interior shoulder may retain a portion of the piston within the cavity. The second interior shoulder may further comprise a washer and fastener adapted to retain the spring within the cavity of body. The fastener may be a snap ring. The latch may further comprise exterior threads on the second end of the body. The exterior shoulder and exterior threads may be adapted to connect a tube to the shotgun receiver. The spring may be positioned within a recess within the piston.

A shotgun receiver system is also disclosed. The system may comprise a dynamic latch which may be connected to a shotgun receiver. The dynamic latch may be adapted to selectively retain a magazine in a magazine port of the shotgun receiver. The system may further comprise a tube. A portion of the dynamic latch may connect the tube to the shotgun receiver. The dynamic latch may comprise a housing, a spring, and a piston having a latch profile. The spring and piston may be positioned within the housing. The magazine may be inserted into the magazine port without the rotation of the magazine about the dynamic latch. The magazine may be moved in a single direction to insert the magazine into the magazine port. The system may further comprise a barrel, which may be inserted into a portion of the shotgun receiver, and a connector mechanism that may connect the magazine tube to the barrel. The connector mechanism may secure the barrel to the shotgun receiver. The connector mechanism may comprise a lug on the barrel and a nut threaded onto the tube adjacent to the lug.

A method of using a magazine with a shotgun receiver is disclosed. The method may comprise inserting the magazine in a first direction into a magazine port of the shotgun receiver, engaging a latch profile with a first locking profile on the magazine, moving the latch profile away from the magazine to permit the first locking profile to move in the first direction past the latch profile, and moving the latch profile back towards the magazine. The latch profile may engage the first locking profile, selectively retaining the magazine within the magazine port. Inserting the magazine into the magazine port may be done without rotation of the magazine about the latch profile. Inserting the magazine into the magazine port may further comprise movement in a single direction. The method may further comprise engaging with the magazine a second locking profile on a dynamic lever. The method may further comprise moving the dynamic lever to release the magazine from the magazine port. The method may further comprise moving the latch profile away from the magazine to permit the first locking profile to move in a second direction past the latch profile after moving the dynamic lever to release the magazine from the magazine port.

These and other embodiments of the present application will be discussed more fully in the description. The features, functions, and advantages can be achieved independently in various embodiments of the claimed invention, or may be combined in yet other embodiments.

Figure 1:
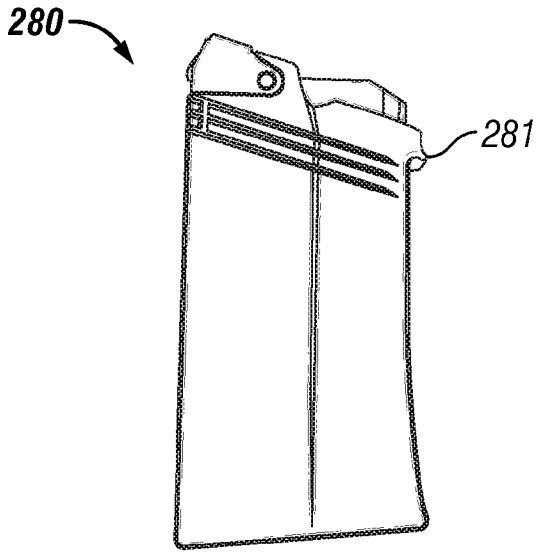
FIG. 1 (Prior Art)
FIG. 1 is a side view of a shotgun magazine with a locking profile.
Figure 2:
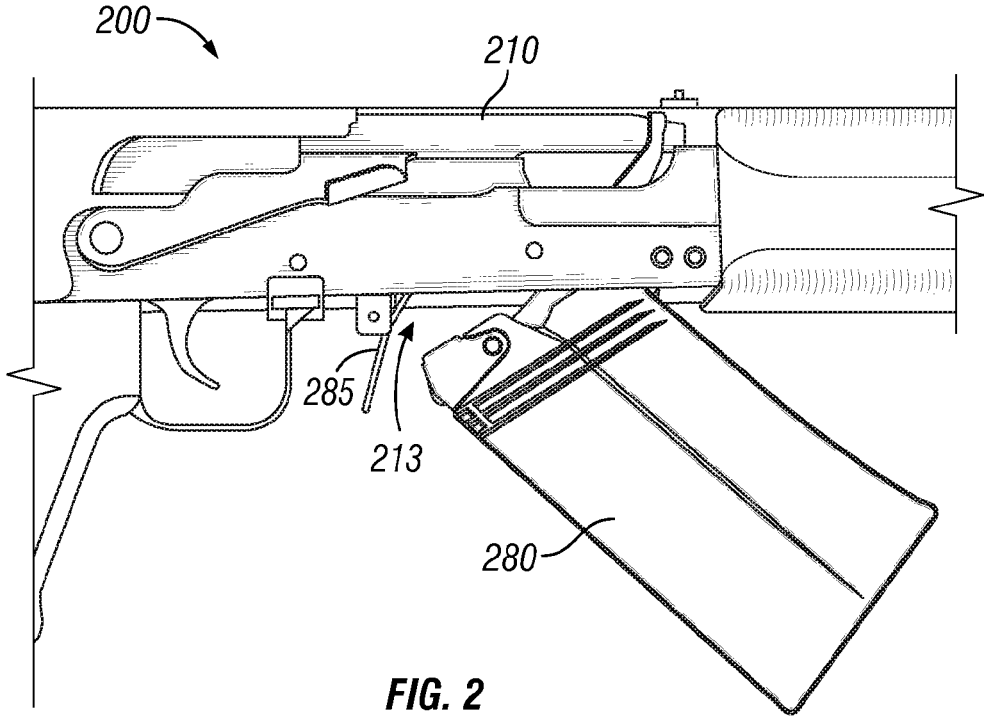
FIG. 2 (Prior Art)
FIG. 2 is a partial side view of a shotgun magazine being inserted into the receiver of a SAIGA® shotgun.
Figure 3:
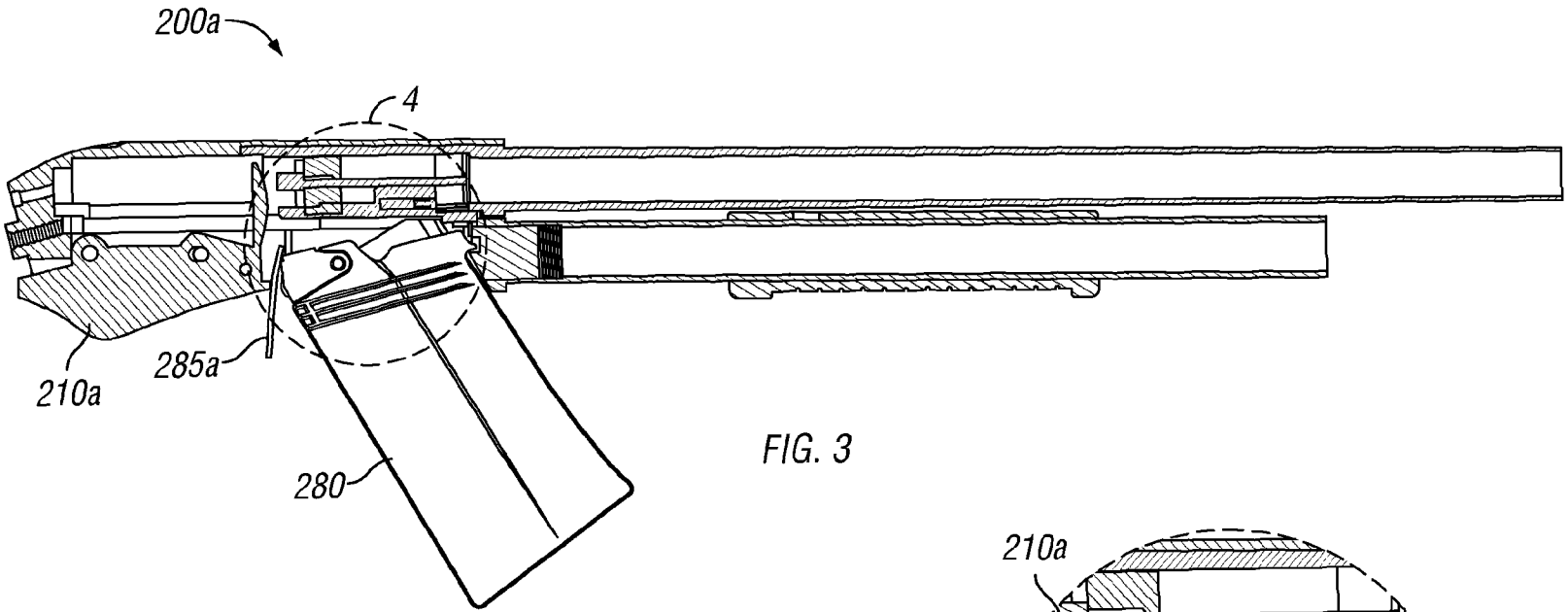
FIG. 3 is a cross-sectional side view of a magazine being inserted into shotgun receiver having a static latch mechanism.
Figure 4:
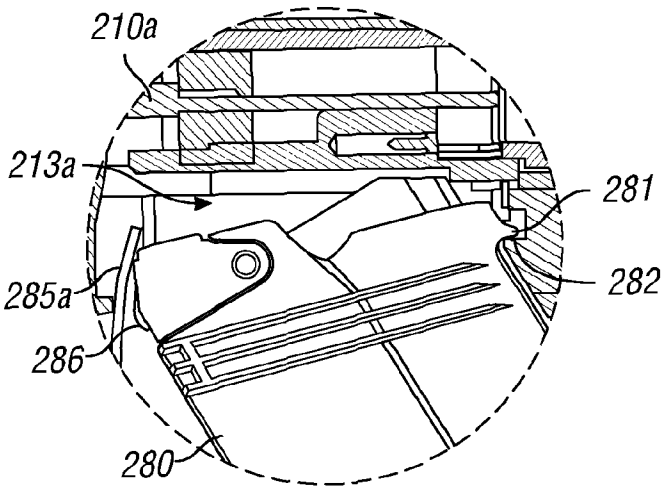
FIG. 4 is a cross-section close up view of the locking profile of the magazine engaging the static latch mechanism shown in FIG. 3.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope as defined by the appended claims.

DESCRIPTION OF ILLUSTRATIVE EMBODIMENTS

Illustrative embodiments are described below as they might be employed in a dynamic latch for use in a standard shotgun receiver. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 5:
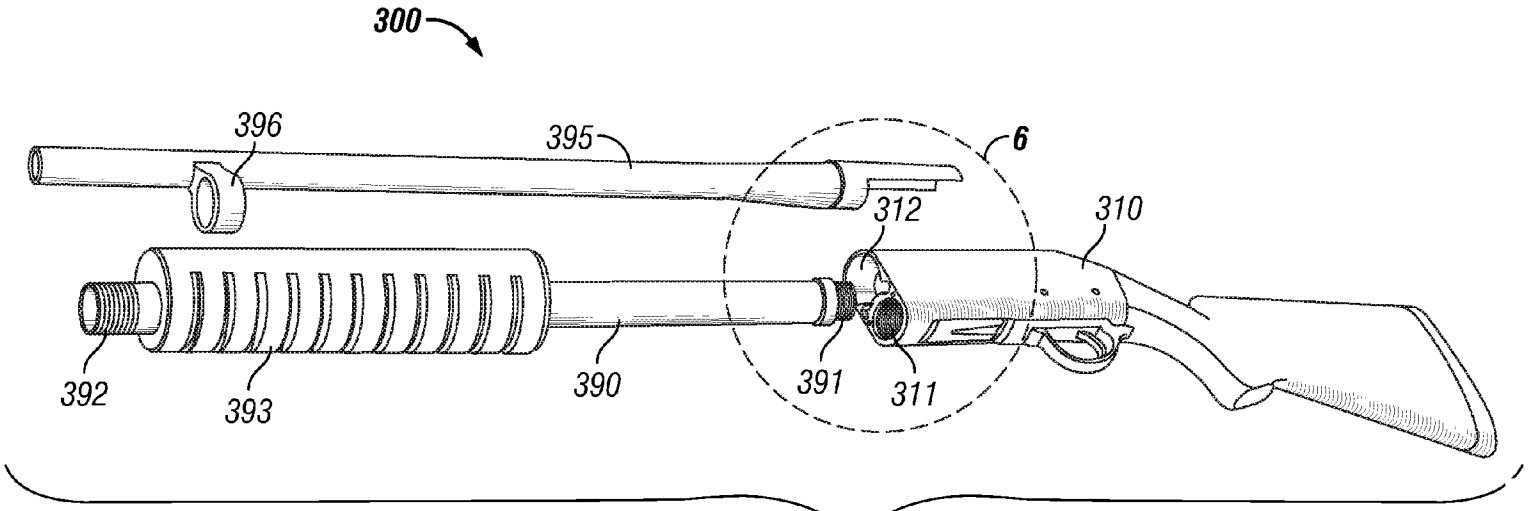
FIG. 5 (Prior Art)
FIG. 5 is an exploded view of some of the components of a prior art shotgun.
Figure 6:
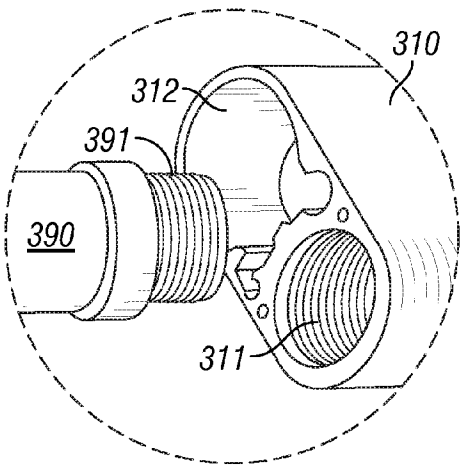
FIG. 6 (Prior Art)
FIG. 6 is a close up view of the receiver and the end of the magazine tube of the shotgun of FIG. 5.
Figure 7:
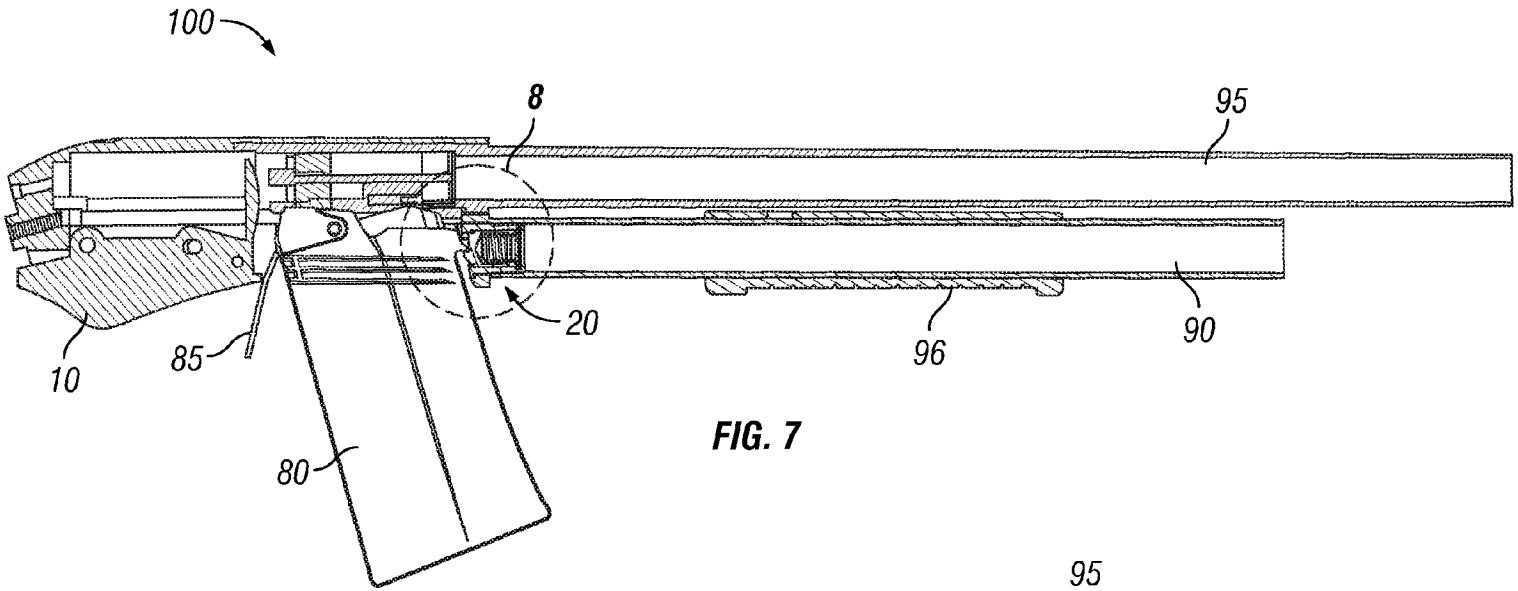
FIG. 7 is a side cross-sectional view of a shotgun including an embodiment of a dynamic latch that may be used to selectively secure a magazine within the magazine port of the receiver.

FIG. 7 shows a shotgun 100 that includes an embodiment of a dynamic front latch 20 connected to the receiver 10. The dynamic latch 20 selectively retains a magazine 80 within the magazine port 13 (shown in FIG. 13) of the receiver 10 in combination with a dynamic lever 85. The lever 85 may be actuated to release the magazine 80 from the magazine port 13. Upon actuating the lever 85, which releases the magazine 80 from the rear locking profile, the downward movement of the magazine 80 causes the dynamic latch 20 to also release the magazine 80 because of the dynamic nature of the latch profile, as discussed below. A tube 90, such as a magazine tube, is connected to a portion of the dynamic latch 20. As discussed below, the tube 90 may be threaded onto an end of the dynamic latch 20 securing both the dynamic latch 20 and the tube 90 to the receiver 10. A barrel 95 is inserted into a bore in the receiver 10 so that the bore of the barrel 95 is aligned with the chamber of the receiver 10. A connection mechanism, such as the lug 396 shown in FIG. 5 and a nut, may be used to connect the barrel 95 to tube 90. The lug 396 may be inserted over the end of the tube 90 as the barrel 95 is inserted into the bore in the receiver 10. The end of the tube 90 may include a threaded section such that a nut may be tightened onto the tube 90 against the lug 396 thus, securing the barrel 95 against the receiver 10.

The dynamic latch 20 permits the insertion of the magazine 80 into the magazine port 13 in substantially a single direction as opposed to the prior art latching mechanisms, which first require alignment of a latching profile and then rotation of the magazine 80 to engage a dynamic release lever. Specifically, the prior art requires a magazine tab, or locking profile, to be first inserted into a static latching mechanism, such as a corresponding recess, and requires that the magazine then be rotated about the tab until a profile on the release lever engages a second locking profile on the magazine. As discussed above if the tab is not properly aligned prior to rotation, the magazine may not properly lock within the magazine port. This may require repeated attempts for a user to properly secure the magazine within the magazine port. This may be problematic in various stressful situations, such as in combat. The dynamic latch 20 potentially prevents this problem by eliminating the need to rotate the magazine 80 to secure it within the magazine port 13. The dynamic latch 20 may be adapted to be used in connection with a standard shotgun receiver 110, potentially reducing manufacturing costs.

Figure 8:
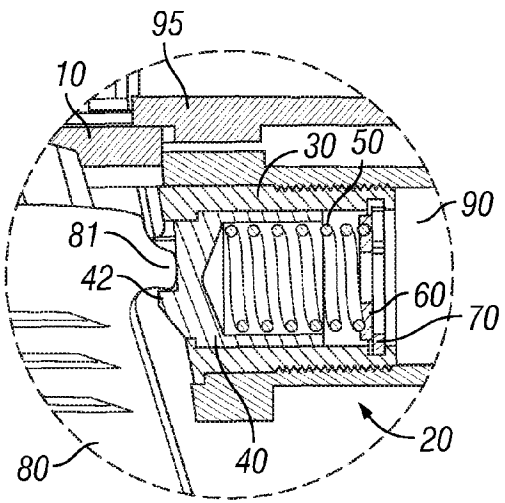
FIG. 8 is a close up cross-section view of the dynamic latch of FIG. 7 engaging the locking profile on the magazine.
Figure 9:
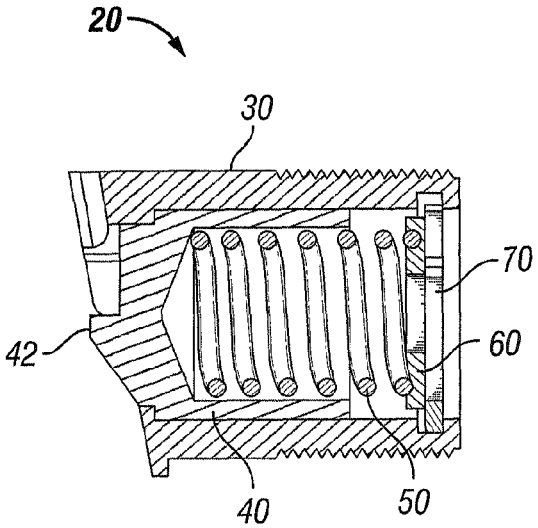
FIG. 9 is a cross-section view of an embodiment of a dynamic latch.
Figure 10:
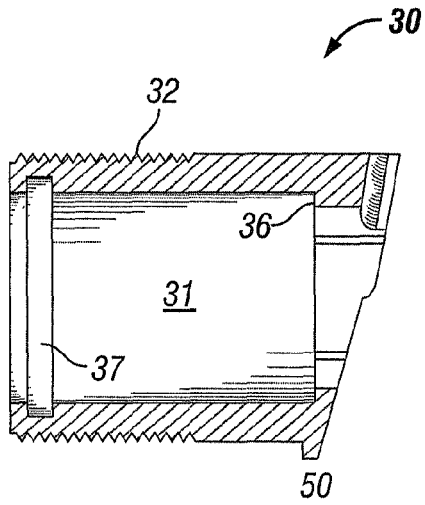
FIG. 10 is a cross-section view of an embodiment of a housing that may be a component of a dynamic latch.
Figure 12:
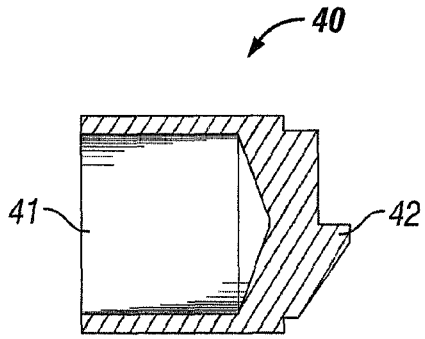
FIG. 12 is a cross-section view of an embodiment of a piston that may be a component of a dynamic latch.

FIG. 8 is a close up cross-section view showing the locking profile 81, or tab, of the magazine 80 engaged and thus, retained within the magazine port 13 by the latching profile 42 of the dynamic latch 20. FIG. 9 shows a cross-section of an embodiment of the dynamic latch 20. The dynamic latch 20 includes an outer housing 30 having an inner cavity 31 (shown in FIG. 10). A piston 40 having a latch profile 42 (shown in FIG. 12) is positioned within the cavity 31 of the housing 30. The piston 40 includes a cavity 41 (shown in FIG. 12) in which a spring 50 is positioned. The housing 30 includes an opening 33 at a first end that is sized to permit only a portion of the piston 40, such as at least the latch profile 42, to protrude out of the opening 33. A portion of the piston 40 may abut a first interior shoulder 36 when the latch profile 42 protrudes out of the opening 33. A retaining device is used at the second end of the housing 30 to retain the piston 40 and the spring 50 within the cavity 31. For example, a washer 60 and snap ring 70 may be used in combination to retain the piston 40 and spring 50 within the housing 30. The snap ring 70 may engage a groove 37, or interior shoulder, within the inner surface of the housing 30. The washer 60 and snap ring 70 are shown for illustrative purposes only as various fasteners and configurations may be used to retain the piston 40 and spring 50 within the housing 30 as would be appreciated by one of ordinary skill in the art having the benefit of this disclosure.

The spring 50 may be adapted to be in an initial substantially uncompressed state when assembled within the piston 40 in the housing 30 of the dynamic latch 20. The piston 40, spring 50, and housing 30 are adapted so that the latch profile 42 of the piston 40 protrudes out of the opening 33 when the spring 50 is in a substantially uncompressed state. As a magazine 80 is inserted into the magazine port 13 of the receiver 10, the locking profile 81 engages the latch profile 42. The movement of the magazine 80 will cause the locking profile 81 to push against the latch profile 42 compressing the spring 50 moving the piston 40 away from magazine 80. The movement of the piston 40 permits the locking profile 81 to move past the latch profile 42 into the loaded position within the magazine port 13. Once the locking profile 81 has moved past the latch profile 42, the spring 50 will return to its initial substantially uncompressed state moving the piston 40 outward so that the latch profile 42 engages the locking profile 81 locking the magazine 80 in the magazine port 13, as shown in FIG. 8.

The dynamic latch 20 permits the magazine 80 to be locked in the magazine port 13 by movement in a single direction rather than requiring the alignment and rotation required to load prior long gun magazine mechanisms, such as the shotgun magazine latches discussed above. When unloading the magazine 80 from the magazine port 13, the spring 50 compresses permitting the locking profile 81 to move past the latch profile 42 after the release lever 85 has been actuated releasing the magazine 80 from the lock profile (not shown) at the rear of the magazine 80.

Figure 11:
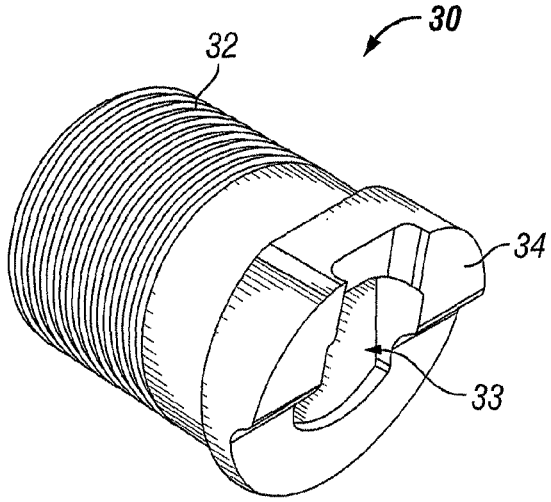
FIG. 11 is an isometric view of the housing of FIG. 10.
Figure 13:
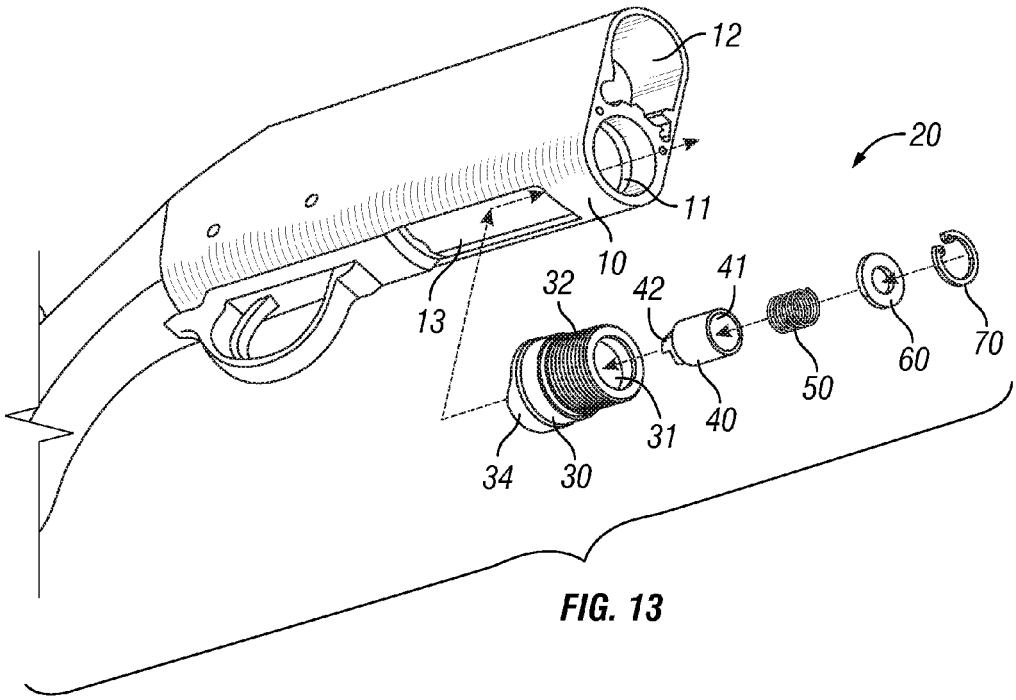
FIG. 13 is an exploded view of an embodiment of the dynamic latch and shotgun receiver.

The housing 30 of the dynamic latch 20 may be adapted to connect a tube 90, such as a magazine tube that is often connected to standard shotgun receivers 10. The housing includes an exterior shoulder 34 on one end and external threads 32 on the other end as shown in FIG. 11. FIG. 13 shows the front end portion of the receiver 10 with an exploded view of the components of an embodiment of the dynamic latch 20. The dynamic latch 20 may be assembled by inserting the spring 50 into the cavity 41 of the piston 40. The piston 40 and spring 50 assembly may then be inserted into the cavity 31 of housing 30 with the washer 60 and snap ring 70 inserted to retain the piston 40 and spring 50 within the housing 30. The dynamic latch assembly 20 may then be inserted through the magazine port 13 into a tube opening 11 of the receiver 10, which may be a magazine tube opening of a standard receiver. The exterior shoulder 34 of the housing 30 will abut against the receiver 10 preventing the entire dynamic latch assembly 20 from moving through the opening 11. The threaded portion 32 of the housing 30 will protrude from the tube opening 11 permitting a tube 90 having internal threads to be threaded onto the housing 30. The tube 90 will be threaded onto the housing 30 until the end of the tube 90 is against the receiver 10 thus, securing both the dynamic latch 20 and the tube 90 to the receiver 10.

Figure 14:
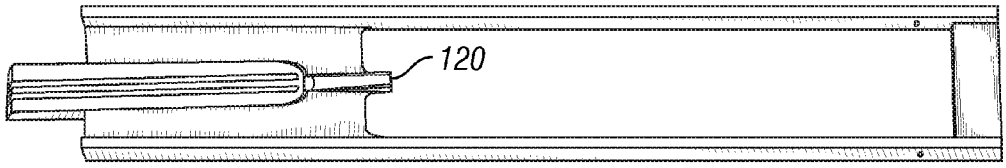
FIG. 14 shows an embodiment of a carrier that may be used in connection with the dynamic latch disclosed herein.

The receiver 10 includes an opening 12 for the insertion of a barrel 95 as well as for the travel of a carrier that is attached to a pump grip 96. The pump grip 96 is adapted to travel along the tube 90 and may be actuated to cycle the firing chamber of the shotgun. As is well known by one of ordinary skill in the art, a carrier may be connected to the pump grip 96 such that upon pumping the pump grip 96 the carrier assists in ejecting a shell, if any, in the chamber, moving a shell into the chamber, and properly positioning the bolt so that the chambered shell may be fired. For illustrative purposes, a carrier 120 is shown in FIG. 14 that may be used in conjunction with the dynamic latch 20 disclosed herein.

Although various embodiments have been shown and described, the invention is not so limited and will be understood to include all such modifications and variations as would be apparent to one skilled in the art. For example, equivalent elements may be substituted for those specifically shown and described, certain features may be used independently of other features, and the number and configuration of various vehicle components described above may be altered, all without departing from the spirit or scope of the invention as defined in the appended claims.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A shotgun comprising a receiver, a magazine port into the receiver, a latch in the magazine port, and a tube connected to the receiver, the latch being configured to selectively secure a magazine in the magazine port and the latch including:

a body having a first end, a second end, an inner cavity, an opening in the first end, an exterior shoulder at the first end, a first interior shoulder at the first end, a second interior shoulder at the second end, and exterior threads on the second end of the body, the exterior shoulder and exterior threads connecting the tube to the shotgun receiver;

a piston having a first end and a second end, the piston being positioned within the cavity, wherein the first end of the piston includes a latch profile; and a spring positioned in the cavity between the piston and the second interior shoulder;

wherein a portion of the latch profile protrudes out of the opening in the first end of the body when the spring is in an uncompressed state.

2. The shotgun of claim 1, wherein pressing the latch profile protruding out of the opening compresses the spring and moves the piston towards the second end of the body.

3. The shotgun of claim 2, further comprising a magazine having a locking profile configured so that, as the magazine is inserted into the magazine port, the locking profile engages the latch profile, compressing the spring and moving the piston towards the second end of the body and, after the locking profile has passed the latch profile, the spring moves the piston towards the first end of the body so that the latch profile selectively retains the locking profile.

4. The shotgun of claim 1, wherein the first interior shoulder retains a portion of the piston within the cavity.

5. The shotgun of claim 1, further comprising a washer and fastener configured to retain the spring within the cavity of body, the fastener engaging the second interior shoulder.

6. The shotgun of claim 5, wherein the fastener is a snap ring.

7. The shotgun of claim 1, wherein the spring is positioned within a recess within the piston.

8. A shotgun comprising:

a receiver, a magazine port into the receiver, and a magazine in the magazine port;

a dynamic latch connected to the shotgun receiver, the dynamic latch being configured to selectively retain the magazine in the magazine port of the shotgun receiver; and a tube, a portion of the dynamic latch connecting the tube to the shotgun receiver.

9. The shotgun of claim 8, wherein the dynamic latch comprises a housing, a spring, and a piston having a latch profile, wherein the spring and piston are positioned within the housing.

10. The shotgun of claim 8, wherein the magazine may be inserted into the magazine port without the rotation of the magazine about the dynamic latch.

11. The shotgun of claim 8, wherein the magazine may be moved in a single direction to insert the magazine into the magazine port.

12. The shotgun of claim 8 further comprising a barrel inserted into a portion of the shotgun receiver and a connector mechanism that connects the tube to the barrel, wherein the connector mechanism secures the barrel to the shotgun receiver and the tube comprises a magazine tube.

13. The shotgun of claim 12, wherein the connector mechanism comprises a lug on the barrel and a nut threaded onto the magazine tube adjacent to the lug.

* * * * *